US009261113B2

(12) United States Patent
Ramler et al.

(10) Patent No.: US 9,261,113 B2
(45) Date of Patent: Feb. 16, 2016

(54) DUAL STAGE PILOTED FORCE REDUCTION VALVE

(75) Inventors: Matthew J. Ramler, Luxemburg, IA (US); Calin Raszga, Dubuque, IA (US)

(73) Assignee: DEERE + COMPANY, Moline, IL (US)

( * ) Notice: Subject to any disclaimer, the term of this patent is extended or adjusted under 35 U.S.C. 154(b) by 804 days.

(21) Appl. No.: 13/591,471

(22) Filed: Aug. 22, 2012

(65) Prior Publication Data

US 2014/0053719 A1 Feb. 27, 2014

(51) Int. Cl.
*F15B 13/04* (2006.01)
*F15B 11/028* (2006.01)

(52) U.S. Cl.
CPC ..... *F15B 11/028* (2013.01); *F15B 2211/30535* (2013.01); *F15B 2211/3122* (2013.01); *F15B 2211/50518* (2013.01); *F15B 2211/5159* (2013.01); *F15B 2211/528* (2013.01); *F15B 2211/55* (2013.01); *F15B 2211/5753* (2013.01)

(58) Field of Classification Search
CPC ..... F15B 11/024; F15B 11/028; F15B 2211/3122; F15B 2211/355; F15B 2211/50518; F15B 2211/5159; F15B 2211/528; F15B 2211/55; F15B 2211/5753; F15B 2013/0428
USPC ..... 91/420, 442, 445, 449
See application file for complete search history.

(56) References Cited

U.S. PATENT DOCUMENTS

| | | | | |
|---|---|---|---|---|
| 4,727,793 | A * | 3/1988 | Hall | 91/451 |
| 5,050,483 | A * | 9/1991 | Yoshikawa et al. | 91/442 |
| 6,314,729 | B1 | 11/2001 | Crull et al. | |
| 7,392,653 | B2 * | 7/2008 | Sugano | 60/452 |
| 7,562,615 | B2 * | 7/2009 | Abe et al. | 91/436 |

* cited by examiner

*Primary Examiner* — Dwayne J White
*Assistant Examiner* — Logan Kraft
(74) *Attorney, Agent, or Firm* — Taft Stettinius & Hollister LLP

(57) ABSTRACT

A pressurized fluid subassembly comprising: (a) a fluid driven actuator configured to utilize fluid at a high pressure to change an overall length of the fluid driven actuator; and, (b) a sequence valve interposing a low pressure line and a supply line conveying the fluid to the fluid driven actuator, the sequence valve including a first sequence configured to inhibit fluid communication between the supply line and the low pressure line when the fluid at the high pressure is actively supplied to the fluid driven actuator, the sequence valve including a second sequence configured to establish fluid communication between the supply line and the low pressure line when the fluid at the high pressure is not actively supplied to the fluid driven actuator, wherein the sequence valve includes a variable bias that changes depending upon whether the fluid at the high pressure is actively supplied to the fluid driven actuator.

19 Claims, 4 Drawing Sheets

DUAL STAGE PILOTED FORCE REDUCTION VALVE

FIELD OF THE INVENTION

The present invention is directed to methods and devices utilized as part of a pressurized fluid delivery system.

BACKGROUND OF THE INVENTION

Those familiar with timber harvesting are familiar with feller bunchers, such as the 900K-Series feller buncher manufactured and sold by John Deere. Feller bunchers are utilized to rapidly harvest trees using a boom to reposition a felling head. Typical felling heads have a large disc saw that is used to cut the base of a tree, while repositionable arms of the felling head are used to grasp the stem of the tree as the tree is being cut. While the tree is being cut and after the tree is severed from its base, it continues to be grasped by the felling head arms and rides upon a butt plate. The operator of the feller buncher then tilts the felling head and allows gravity to lay the tree down.

While laying down the cut tree, the feller head and boom may be subjected to kick-back or rebound forces as the tree bounces on the ground. These rebound forces are absorbed by components of the feller buncher's hydraulic system, namely the hydraulic cylinders associated with the feller head and boom. More specifically, the rebound forces applied to the hydraulic cylinders result in rapid hydraulic pressure increases within the cylinders, sometimes resulting in cylinder failure. While one alternative would be incorporation of larger, more robust hydraulic cylinders, this incorporation has ripple effects that require many other components such as the hydraulic pump and hoses to be more robust and substantially less efficient. Additional issues are also encountered such as, without limitation, additional weight and potential redesign of the feller head and feller boom to withstand the increased forces that can be transmitted by more robust hydraulic cylinders. Consequently, there is a need for a solution to account for rebound forces that may be applied to the feller buncher's hydraulic system without requiring a complete redesign of the hydraulic system or the equipment (feller head and boom) repositioned by the hydraulic system.

SUMMARY

It is a first aspect of the present invention to provide a pressurized fluid subassembly comprising: (a) a fluid driven actuator configured to utilize a fluid at a high pressure to change an overall length of the fluid driven actuator; and, (b) a sequence valve interposing a low pressure line and a supply line conveying the fluid to the fluid driven actuator, the sequence valve including a first sequence configured to inhibit fluid communication between the supply line and the lower pressure line when the fluid at the high pressure is actively supplied to the fluid driven actuator, the sequence valve including a second sequence configured to establish fluid communication between the supply line and the lower pressure line when the fluid at the high pressure is not actively supplied to the fluid driven actuator, where the sequence valve includes a variable bias that changes depending upon whether the fluid at the high pressure is actively supplied to the fluid driven actuator.

In a more detailed embodiment of the first aspect, the fluid driven actuator comprises a piston and a cylinder, the cylinder and the piston cooperating to define a head side cavity and a rod side cavity that are interposed by a head of the piston, the supply line comprises a head side supply line conveying the fluid to the head side cavity, the supply line comprises a rod side supply line conveying the fluid to the rod side cavity, and the sequence valve is in fluid communication with the head side supply line conveying the fluid to the head side cavity, the sequence valve is configured to inhibit fluid communication between the head side supply line and the lower pressure line when the fluid at the high pressure is actively supplied to the fluid driven actuator, the sequence valve is configured to establish fluid communication between the head side supply line and the lower pressure line when the fluid at the high pressure is not actively supplied to the fluid driven actuator.

In a further detailed embodiment, the pressurized fluid subassembly further includes a control valve having a repositionable flow control configured to establish fluid communication between a high pressure source and the sequence valve via a pilot line and configured to establish fluid communication between the high pressure source and at least one of the head side cavity and the rod side cavity when the repositionable flow control is in its active position, the repositionable flow control configured to discontinue fluid communication between the high pressure source and the sequence valve via the pilot line and configured to discontinue fluid communication between the high pressure source and both the rod side cavity and the head side cavity when the repositionable flow control is in its standby position, wherein a pressure within the pilot line comprises the variable bias.

In still a further detailed embodiment, the control valve comprises a spool valve, the repositionable flow control comprises a first spool section, the first spool section is repositionable between the active position and the standby position, where the active position establishes fluid communication between the high pressure source and the sequence valve via the pilot line and establishes fluid communication between the high pressure source and the head side cavity, and where the standby position discontinues fluid communication between the high pressure source and the sequence valve via the pilot line and discontinues fluid communication between the high pressure source and the head side cavity.

In a more detailed embodiment, the first spool section is configured so that in the standby position, fluid communication is established between a low pressure drain and the sequence valve via the pilot line. In a more detailed embodiment, the repositionable flow control comprises a second spool section, the second spool section is repositionable between the active position and the standby position, where the active position establishes fluid communication between the high pressure source and the sequence valve via the pilot line and establishes fluid communication between the high pressure source and the rod side cavity, and where the standby position discontinues fluid communication between the high pressure source and the sequence valve via the pilot line and discontinues fluid communication between the high pressure source and the rod side cavity.

In another more detailed embodiment, the sequence valve includes a low pressure outlet in fluid communication with the low pressure line, a pilot inlet in fluid communication with the pilot line, a first high pressure inlet in fluid communication with the supply line, a second high pressure inlet in fluid communication with the supply line, and where a pressure within the second high pressure inlet detracts from the variable bias. In yet another more detailed embodiment, the sequence valve includes a spring providing a constant bias that comprises at least a portion of the variable bias.

In yet another more detailed embodiment of the first aspect, the pressurized fluid subassembly further includes a relief valve in fluid communication with the supply line, and an anti-cavitation valve in fluid communication with the supply line, where the relieve valve is configured to establish fluid communication between the supply line and the lower pressure line when a pressure of the fluid within the supply line exceeds a high end pressure, the anti-cavitation valve is configured to establish fluid communication between the supply line and the lower pressure line when the pressure of the fluid within the supply line falls below a low end pressure. In still another more detailed embodiment, the variable bias of the sequence valve is operative to inhibit fluid communication between the supply line and the lower pressure line above the high end pressure when the fluid at the high pressure is actively supplied to the fluid driven actuator, and the variable bias of the sequence valve is operative to establish fluid communication between the supply line and the lower pressure line below the high end pressure when the fluid at the high pressure is not actively supplied to the fluid driven actuator.

In a further detailed embodiment, the pressurized fluid subassembly further includes a control valve having a repositionable flow control configured to establish fluid communication between a high pressure source and the sequence valve via a pilot line and configured to establish fluid communication between the high pressure source and the fluid driven actuator when the repositionable flow control is in its active position, the repositionable flow control configured to discontinue fluid communication between the high pressure source and the sequence valve via the pilot line and configured to discontinue fluid communication between the high pressure source and the fluid driven actuator when the repositionable flow control is in its standby position, wherein a pressure within the pilot line comprises the variable bias. In still a further detailed embodiment, the pressurized fluid subassembly further includes a controller in communication with the control valve, the controller configured to control repositioning of the flow control between the active position and the standby position.

In a more detailed embodiment, the control valve comprises a spool valve, the repositionable flow control comprises a first spool section and a second spool section, the first spool section is repositionable between the active position and the standby position, where the active position of the first spool section establishes fluid communication between the high pressure source and the sequence valve and establishes fluid communication between the high pressure source and a first cavity of the fluid driven actuator, and where the standby position of the first spool section discontinues fluid communication between the high pressure source and the sequence valve via and discontinues fluid communication between the high pressure source and the first cavity, the second spool section is repositionable between the active position and the standby position, where the active position of the second spool section establishes fluid communication between the high pressure source and the sequence valve and establishes fluid communication between the high pressure source and a second cavity of the fluid driven actuator, and where the standby position of the second spool section discontinues fluid communication between the high pressure source and the sequence valve and discontinues fluid communication between the high pressure source and the second cavity, the controller is in fluid communication with the first spool section via a first spool control line, the controller is configured to control repositioning of the first spool section by hydraulically repositioning the first spool section between the active position and the standby position, and the controller is in fluid communication with the second spool section via a second spool control line, the controller is configured to control repositioning of the second spool section by hydraulically repositioning the second spool section between the active position and the standby position.

It is a second aspect of the present invention to provide a pressurized fluid subassembly comprising: (a) a hydraulic cylinder having a first fluid port and a second fluid port, the first fluid port in communication with a head side cavity, the second port in communication with a rod side cavity, the head side cavity and the rod side cavity interposed by a piston wall; (b) a sequence valve having a repositionable flow control and configured to have a first sequence that inhibits fluid communication between a first orifice of the sequence valve and a second orifice of the sequence valve, and the repositionable flow control configured to have a second sequence that establishes fluid flow through the sequence valve along a first pathway between the first orifice and the second orifice, the sequence valve also including a first bias opening and a second bias opening, the first and second bias openings in communication with the repositionable flow control and are configured to deliver a fluid to the repositionable flow control to cause repositioning of the repositionable flow control between the first sequence and the second sequence; (c) a fluid line establishing fluid communication between the head side cavity of the hydraulic cylinder and the first orifice of the sequence valve.

In a more detailed embodiment of the second aspect, the pressurized fluid subassembly further includes a control valve in fluid communication with the head side cavity by way of a head side line, the control valve also in fluid communication with the rod side cavity by way of a rod side line, the control valve further in fluid communication with a hydraulic pump by way of a high pressure line, the control valve in still further fluid communication with a hydraulic reservoir by way of a low pressure line, and the control valve in yet further fluid communication with the first bias opening of the sequence valve by way of a pilot line. In yet another more detailed embodiment, the control valve comprises a spool valve including a first spool section and a second spool section, the first spool section is configured to be repositionable between a standby position and an active position, where the active position of the first spool section controls lengthening of the hydraulic cylinder, and the second spool section is configured to be repositionable between a standby position and an active position, where the active position of the second spool section controls shortening of the hydraulic cylinder.

In a further detailed embodiment, the pressurized fluid subassembly includes a controller configured to direct pressurized fluid to the control valve to reposition the first spool section between the active position and the standby position via a first spool line, the controller also configured to direct pressurized fluid to the control valve to reposition the second spool section between the active position and the standby position via a second spool line. In still a further detailed embodiment, the pressurized fluid subassembly includes a relief valve in fluid communication with the first line, the relief valve configured to have a constant bias to allow venting of contents of the first line if the pressure of the contents exceeds a maximum operating pressure, an anti-cavitation valve in fluid communication with the first line, the anti-cavitation valve configured to have a constant bias to allow additional contents to flow into the first line if the pressure of the contents within the first line falls below a minimum operating pressure, where the repositionable flow control of the sequence valve is configured to include a variable bias impacting whether the repositionable flow control is in the first sequence or the second sequence.

In a more detailed embodiment, the first line is in fluid communication with the second bias opening of the sequence valve, the second orifice of the sequence valve is in fluid communication with the low pressure line, the control valve is configured to concurrently establish fluid communication between the high pressure line and the head side cavity and establish fluid communication between the high pressure line and the first bias opening, the repositionable flow control of the sequence valve is configured to include a variable bias impacting whether the repositionable flow control is in the first sequence or the second sequence, and the variable bias includes a constant spring bias to bias the repositionable flow in the first sequence. In a more detailed embodiment, the control valve comprises a spool valve having a first spool section and a second spool section, the first spool section is configured to be repositionable between an active position and a standby position, where the active position of the first spool section establishes fluid communication between the high pressure line and (a) the rod side cavity, and (b) the first sequence opening, where the active position of the first spool section also establishes fluid communication between the head side cavity and the low pressure line, the second spool section is configured to be repositionable between an active position and a standby position, where the active position of the second spool section establishes fluid communication between the high pressure line and (a) the rod side cavity, and (b) the first sequence opening, the control valve is configured to inhibit fluid communication between the high pressure line and (a) the rod side cavity, (b) the head side cavity, and configured to establish fluid communication between the first sequence opening and the low pressure line, when the first and second spool sections are both in the standby position.

It is a third aspect of the present invention to provide a method of operating a pressurized fluid subassembly comprising: (a) actively supplying a fluid at a high pressure to a fluid driven actuator and to a sequence valve, where the fluid at the high pressure supplied to the fluid driven actuator is operative to actively reposition the fluid driven actuator, the fluid at the high pressure supplied to the sequence valve increases a bias of the sequence valve to inhibit fluid communication between the fluid at the high pressure and a lower pressure drain; and, (b) discontinuing actively supplying the fluid at the high pressure to the fluid driven actuator and to the sequence valve, where discontinuing actively supplying the fluid at the high pressure to the fluid driven actuator discontinues active repositioning of the fluid driven actuator, and where discontinuing actively supplying the fluid at the high pressure to the sequence valve reduces the bias of the sequence valve to allow fluid communication between the lower pressure drain and the fluid driven actuator when a pressure of the fluid within the fluid driven actuator exceeds a maximum working pressure.

In a more detailed embodiment of the third aspect, the method further includes venting, while discontinuing actively supplying the fluid at the high pressure to the fluid driven actuator and to the sequence valve, the fluid in communication with the fluid driven actuator via the sequence valve to the lower pressure drain during the fluid exceeding the maximum working pressure. In yet another more detailed embodiment, the method further includes venting, while actively supplying a fluid at a high pressure to a fluid driven actuator and to a sequence valve, the fluid in communication with the fluid driven actuator via a check valve to the lower pressure drain during the fluid exceeding the high pressure by a predetermined threshold. In a further detailed embodiment, the method further includes operating a control valve in fluid communication with the fluid driven actuator and the sequence valve, wherein operating the control valve includes establishing fluid communication between a high pressure fluid source and both the fluid driven actuator and the sequence valve when in a first position, and wherein operating the control valve includes discontinuing fluid communication between the high pressure fluid source and both the fluid driven actuator and the sequence valve when in a second position. In still a further detailed embodiment, operating the control valves includes communicating with a controller to receive input from the controller in order for the control valve to move between the first and second positions.

It is a fourth aspect of the present invention to provide a method of operating a pressurized fluid subassembly comprising utilizing a sequence valve in fluid communication with a head side chamber of a hydraulic cylinder to reduce a head side fluid pressure within the head side chamber when the head side fluid pressure exceeds a rod side fluid pressure within a rod side chamber of the hydraulic cylinder by more than a predetermined pressure differential.

In a more detailed embodiment of the fourth aspect, the method further comprises repositioning the hydraulic cylinder by operating a control valve to concurrently establish fluid communication between a high pressure fluid source and the head side chamber and the rod side chamber of the hydraulic cylinder to increase an operating length of the hydraulic cylinder, and the sequence valve to bias the sequence valve to a first sequence discontinuing fluid communication between the high pressure fluid source and a low pressure drain. In yet another more detailed embodiment, the method further comprises discontinuing repositioning the hydraulic cylinder by operating the control valve to concurrently discontinue fluid communication between the high pressure fluid source and (a) the head side chamber and the rod side chamber of the hydraulic cylinder to maintain the operating length of the hydraulic cylinder, and (b) the sequence valve to reduce a bias of the sequence valve to allow fluid communication between the head side chamber and the low pressure drain when the head side fluid pressure exceeds the rod side fluid pressure within the rod side chamber of the hydraulic cylinder by more than the predetermined pressure differential.

In a further detailed embodiment, the method further comprises repositioning the hydraulic cylinder by operating the control valve to concurrently establish fluid communication between the high pressure fluid source and (a) the rod side chamber of the hydraulic cylinder to decrease the operating length of the hydraulic cylinder, and (b) the sequence valve to bias the sequence valve to the first sequence discontinuing fluid communication between the high pressure fluid source and the low pressure drain. In still a further detailed embodiment, the method further comprises discontinuing repositioning the hydraulic cylinder by operating a control valve to concurrently discontinue fluid communication between a high pressure fluid source and (a) the head side chamber and the rod side chamber of the hydraulic cylinder to maintain an operating length of the hydraulic cylinder, and (b) the sequence valve to reduce a bias of the sequence valve to allow a second sequence establishing fluid communication between the head side chamber and a low pressure drain when the head side fluid pressure exceeds the rod side fluid pressure within the rod side chamber of the hydraulic cylinder by more than the predetermined pressure differential.

In a more detailed embodiment, the method further comprises repositioning the hydraulic cylinder by operating a control valve to concurrently establish fluid communication between a high pressure fluid source and (a) the rod side chamber of the hydraulic cylinder to decrease an operating length of the hydraulic cylinder, and (b) the sequence valve to bias the sequence valve to a first sequence discontinuing fluid communication between the high pressure fluid source and a low pressure drain. In a more detailed embodiment, further comprising operating a control valve to inhibit fluid communication between a high pressure fluid source and (a) the head side chamber, thereby trapping fluid in between the sequence valve and the head side chamber, (b) a bias input of the sequence valve, and establishing fluid communication between the bias input of the sequence valve and a low pressure drain to lower a bias of the sequence valve when fluid communication between the high pressure fluid source and the bias input is inhibited. In yet a further detailed embodiment, the predetermined pressure differential is greater than one hundred bar.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

DETAILED DESCRIPTION

Figure 1:
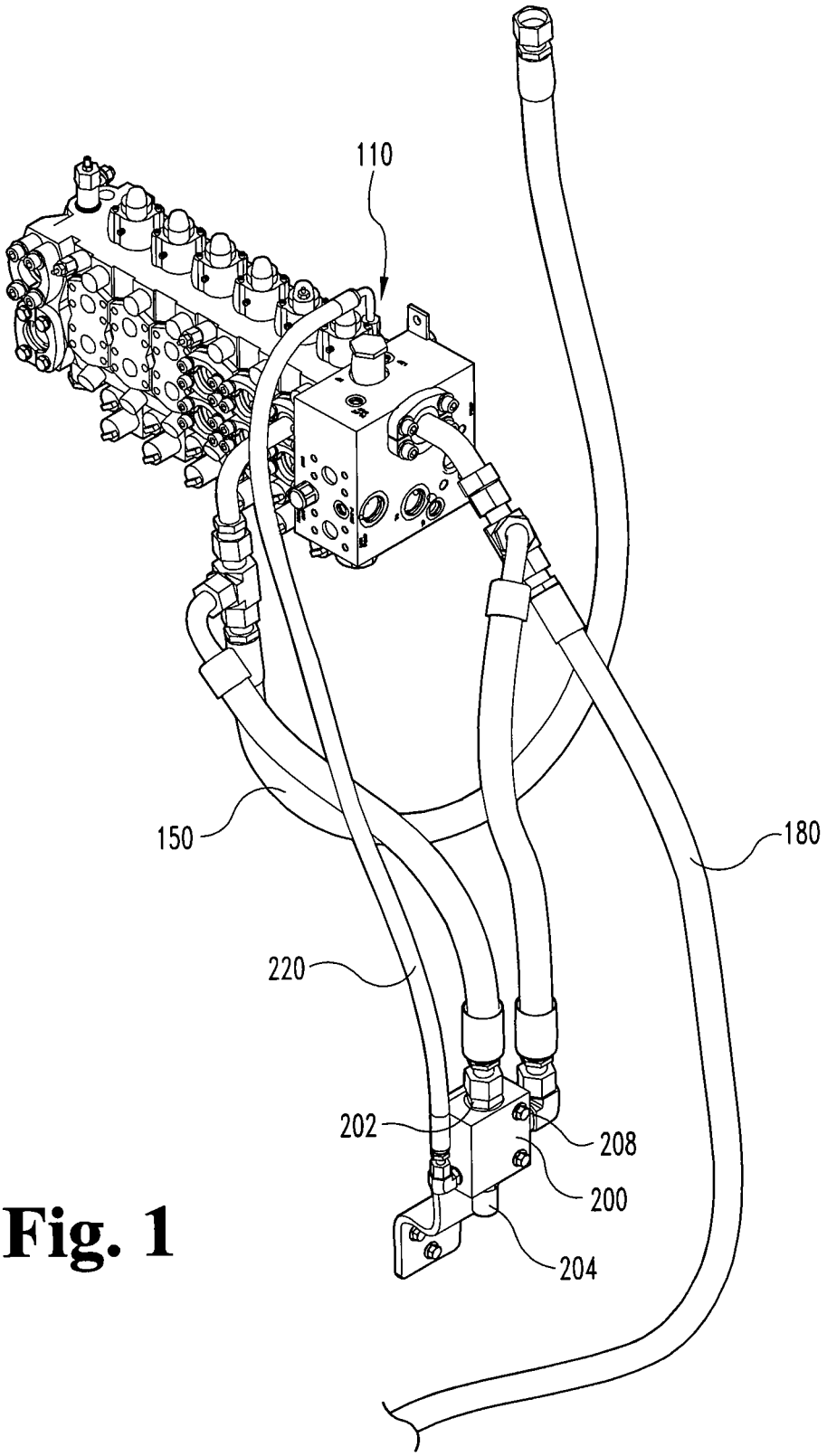
FIG. 1 is an elevated perspective view of a control valve and associated hoses, including connection to a sequence valve.

The exemplary embodiments of the present disclosure are described and illustrated below to encompass methods and devices for use with fluid control systems, such as hydraulic control systems. Of course, it will be apparent to those of ordinary skill in the art that the embodiments discussed below are exemplary in nature and may be reconfigured without departing from the scope and spirit of the present invention. However, for clarity and precision, the exemplary embodiments as discussed below may include optional steps, methods, and features that one of ordinary skill should recognize as not being a requisite to fall within the scope of the present invention.

Referring to FIGS. 1-4, an exemplary hydraulic sub-system 100 is a component of a larger hydraulic system for an industrial piece of equipment. By way of example, the exemplary hydraulic sub-system 100 may be incorporated as part of an overall hydraulic control system such as for a 900K-Series feller buncher manufactured and sold by John Deere.

The exemplary hydraulic sub-system 100 includes a control valve 110 that is hydraulically activated by a controller 120. In this exemplary embodiment, the controller 120 is electronically coupled to an operator input (not shown), such as a joystick, the operator uses to provide input to the controller about movements of certain mechanical components. For example, the joystick may be moved side to side to control the tilt of a feller buncher head (e.g., moving the joystick to the right side tilts the feller buncher head toward the boom, while moving the joystick to the left side tilts the feller buncher head away from the boom). Based upon the electrical inputs to the controller 120, the controller provides certain hydraulic outputs to the control valve 110.

The control valve 110 comprises a spool valve having a retracting section and an extending section 130, 132 to change what fluid inputs are connected with certain fluid outputs. In exemplary form, the retracting section 130 is repositionable within a housing of the control valve between a standby position (see FIG. 2) corresponding to the operator not moving the joystick to the right side, and an active position (see FIG. 3) where the operator is moving or has moved the joystick to the right side. While in the standby position, the retracting section 130 is non-functional and does not play an active part in controlling fluid flow through the control valve 110. Instead, the control valve 110 is set at a default condition (see FIG. 2) because the controller 120 is not pressurizing hydraulic fluid within one of the spool lines 134, 136 (controlled by the controller 120) in order to overcome the return bias of the spool sections 130, 132.

Figure 2:
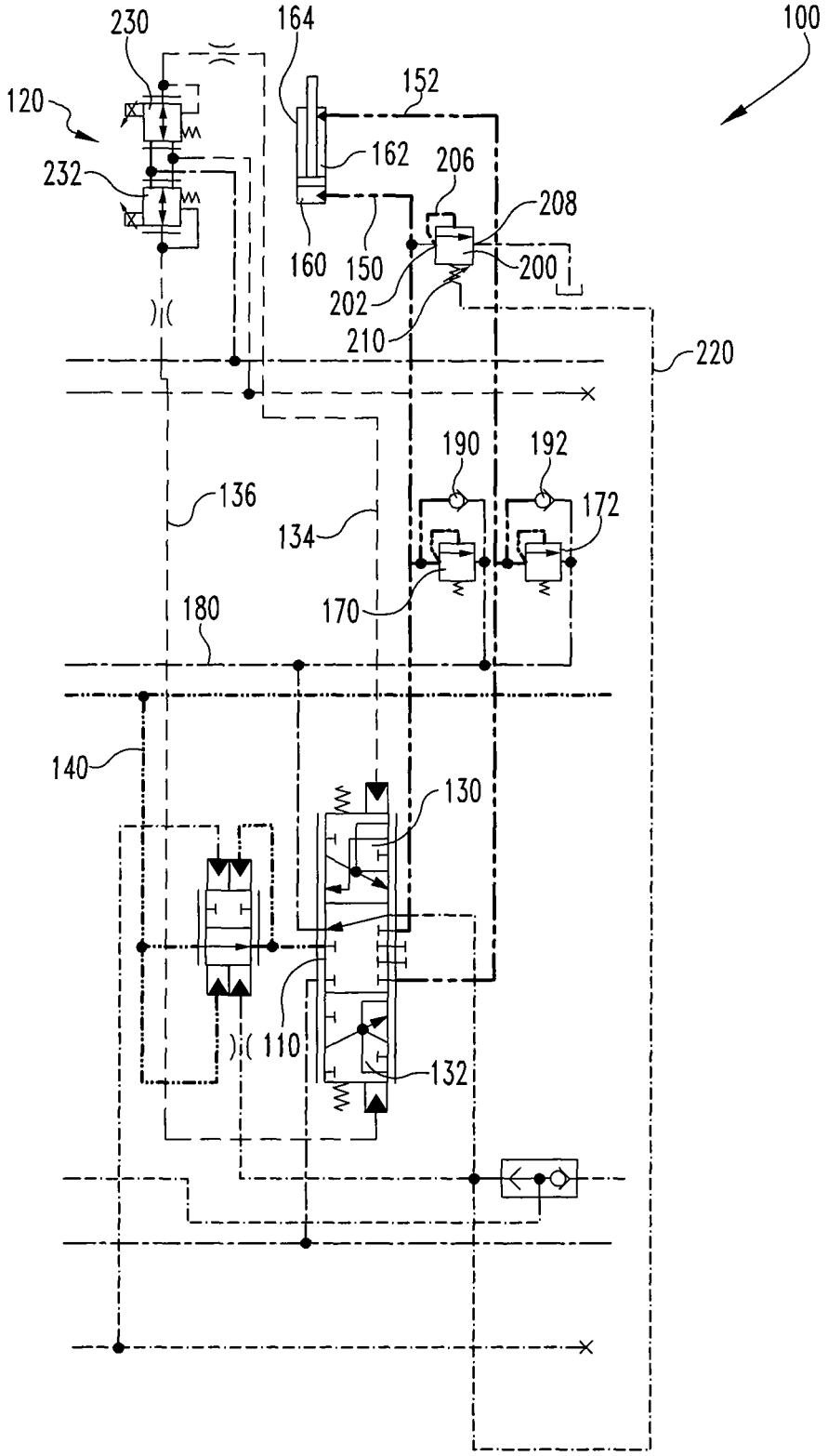
FIG. 2 is a schematic diagram of a hydraulic sub-system in accordance with the instant disclosure showing the spool of the control valve in a standby position.

As shown in FIG. 2, the default condition of the control valve 110 inhibits fluid communication between a high pressure fluid line 140 (coming from a high pressure source such as a pump) and a head side supply line 150 and a rod side supply line 152. The high pressure fluid line 140 is configured to carry hydraulic fluid at a high pressure, while the head side supply line 150 and the rod side supply line 152 provide fluid communication between the control valve 110 and respective cavities 160, 162 of a hydraulic cylinder 164.

In this exemplary embodiment, the hydraulic cylinder 164, the control valve 110 and the associated lines 140, 150, 152 are part of a regenerative hydraulic system. Each of the supply lines 150, 152 is in fluid communication with a respective relief valve 170, 172 that is operative to vent hydraulic fluid above a predetermined pressure to a low pressure tank line 180. In this exemplary embodiment, both relief valves 170, 172 are set to open and provide fluid communication between a respective supply line 150, 152 and the tank line 180 if the hydraulic fluid pressure exceeds a predetermined high pressure (e.g., higher than 250 bar). It should be noted that the predetermined high pressure may be set differently for different hydraulic system, end applications, and machines. It should also be noted that the relief valve pressure setting (i.e., the pressure of hydraulic fluid necessary to open the valve) may changed so that the relief valve opens at pressures above or below the predetermined high pressure (e.g., above or below 250 bar). Likewise, the each relief valve 170, 172 is in parallel with an anti-cavitation valve 190, 192. These anti-cavitation valves 190, 192 are operative to prevent cavitation within the supply lines 150, 152 by supplying low pressure hydraulic fluid from the tank line 180 in circumstances where outside forces are acting on the cylinder 164 causing the cylinder to extend or retract more quickly than the hydraulic pump (not shown) can supply fluid to the cavities 160, 162.

The regenerative hydraulic system also includes a sequence valve 200 in fluid communication with the head supply line 150. The sequence valve 200 includes two sequences where internal components within the valve are repositioned to change flow patterns through the valve. In the first sequence, which is the default sequence that is always active, fluid communication is established between a first inlet 202 (tied to the head supply line 150) and a first outlet 204, or first sequence opening 204. The first outlet 204 is in fluid communication with a loop conduit 206 that is always in fluid communication with the first inlet 202. In the second sequence, fluid communication is established between the first inlet 202 (tied to the head supply line 150) and a second outlet 208, or second sequence opening 208. More specifically, the second sequence establishes fluid communication between the head supply line 150 and the tank line 180 in order to bleed off hydraulic fluid and pressure from the head supply line.

In order to control when pressure and fluid from the head supply line 150 are bled off to the tank line 180, the sequence valve 200 is configured to provide a variable bias. A default bias of the sequence valve 200, which is always present, is provided by mechanical bias. In this exemplary embodiment, the mechanical bias is in the form of one or more springs 210. The spring(s) 210 inhibit the sequence valve from moving from the first sequence to the second sequence as long as the pressure of the hydraulic fluid within the head supply line 150 is less than a predetermined pressure, which is insufficient to overcome the spring 210 bias. For example, the predetermined pressure may be at or above 130 bar. In addition to the bias of the spring(s) 210, the sequence valve 200 also includes a hydraulic bias derived from the pressure of the hydraulic fluid within a pilot line 220. Because the fluid pressure within the pilot line 220 will vary, which will be discussed in more detail hereafter, the bias of the sequence valve is no less than spring(s) 210 bias and may be more in circumstances where the hydraulic bias, attributable to the fluid within the pilot line 220, contributes to the overall sequence valve bias.

Figure 3:
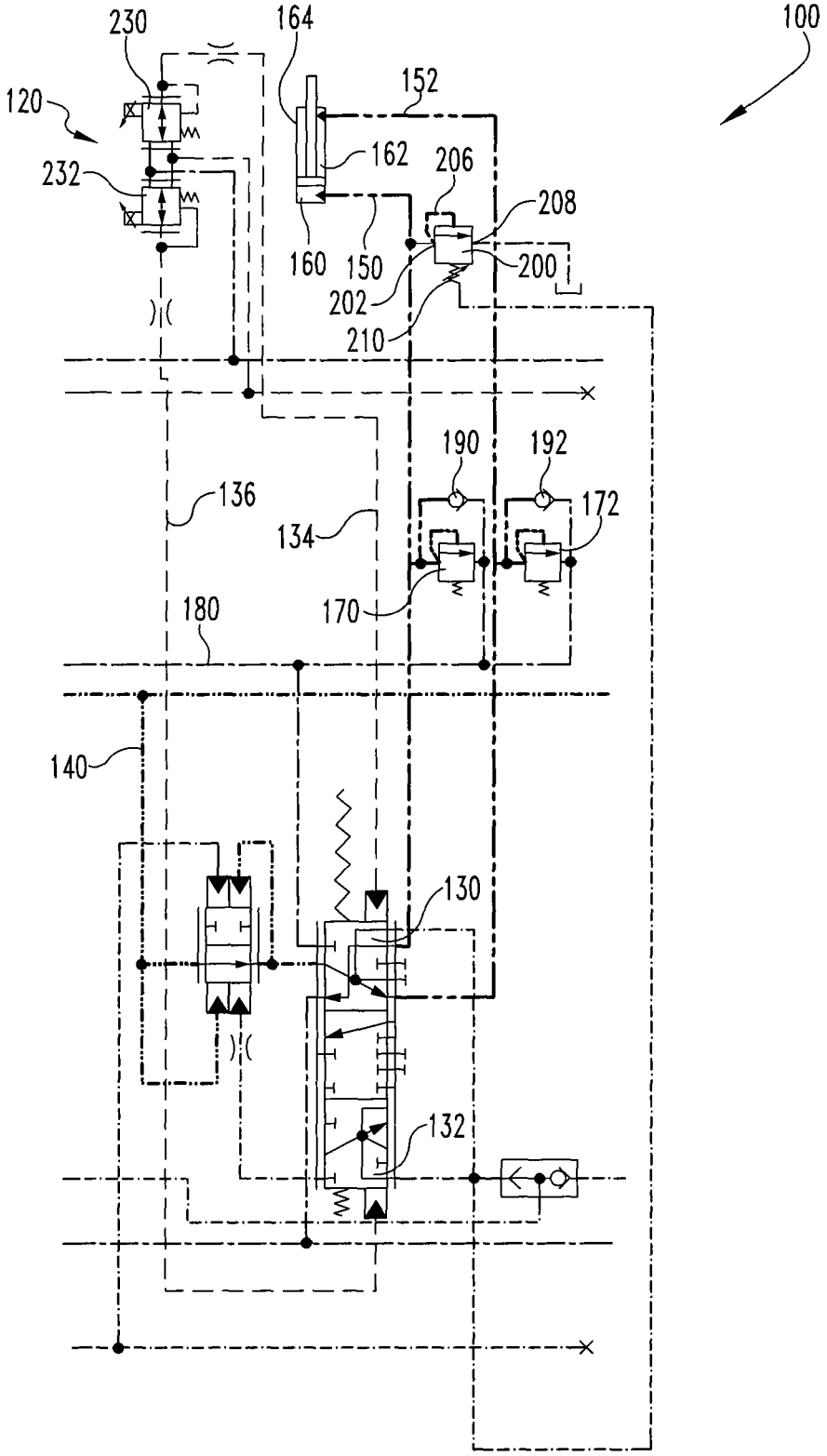
FIG. 3 is a schematic diagram of the exemplary hydraulic sub-system of FIG. 2, where the spool is in a retracting position.

Referring to FIG. 3, when the operator moves the joystick to the right side, thereby intending the tilt the feller buncher head toward the boom, an electronic signal is sent to the controller 120, which causes a valve 230 to open and send pressurized fluid via the first spool line 134 to overcome the return bias of the retracting section 130 and reposition the retracting section from its standby position of FIG. 2 to its active position of FIG. 3. It should also be noted that the controller 120 has not caused the second valve 232 to open and send pressurized fluid via the second spool line 136 to the extending section 130. Thus, the extending section 130 remains in its standby position.

When in the active position, the retracting section 130 is operative to establish fluid communication between the high pressure fluid line 140 and the rod side supply line 152 so that high pressure hydraulic fluid is delivered to the rod side cavity 162. At the same time, the retracting section 130 is operative to establish fluid communication between the high pressure fluid line 140 and the pilot line 220 so that high pressure hydraulic fluid is delivered to the sequence valve 200 to increase its bias. More specifically, because high pressure fluid is delivered concurrently to the pilot line 220 and to the rod supply line 152 when the retracting section 130 is in its active position, the bias added by the spring(s) 210 is unnecessary to retain the sequence valve 200 in the first sequence and inhibit fluid communication between the head supply line 150 and the tank line 180. Likewise, the active position of the retracting section 130 is operative to establish fluid communication between the head side cavity 160 and the tank line 180 via the head side supply line 150 through the control valve 110. It should be noted that the retracting section 130 is only repositioned to its active position when the operator moves the joystick to the right side and only stays in its active position as long as the operator retains the joystick to the right side. When the joystick is moved to its central default position or to the left side, the retracting section 130 is returned to its standby position as shown in FIG. 2.

Figure 4:
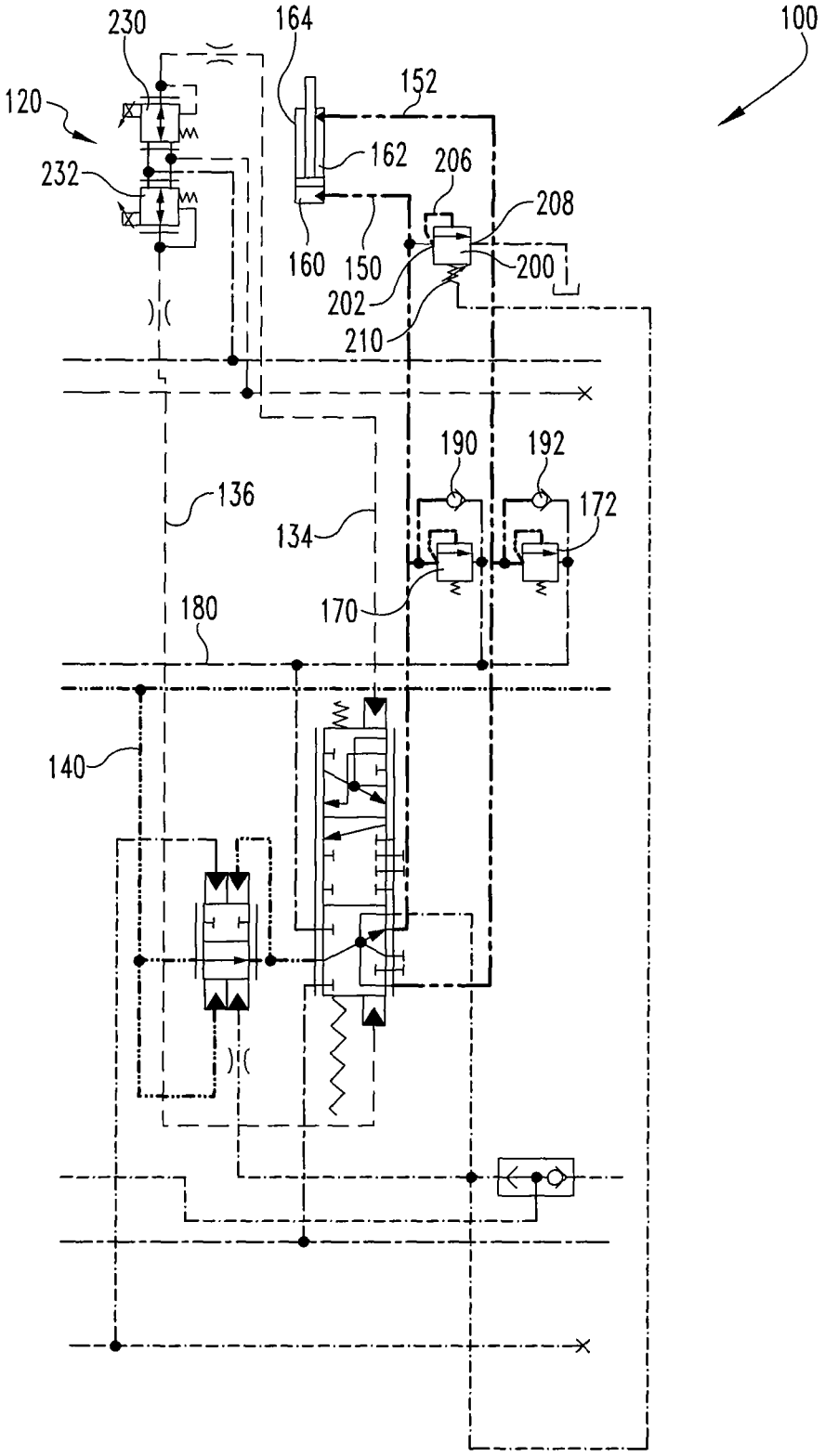
FIG. 4 is a schematic diagram of the exemplary hydraulic sub-system of FIG. 2, where the spool is in an extending position.

Referring to FIG. 4, when the operator moves the joystick to the left side, thereby intending the tilt the feller buncher head away from the boom, an electronic signal is sent to the controller 120, which causes the second valve 232 to open and send pressurized fluid via the second spool line 136 to overcome the return bias of the extending section 132 and reposition the extending section from its standby position of FIG. 2 to its active position of FIG. 4. It should also be noted that the controller 120 has not caused the first valve 230 to open and send pressurized fluid via the first spool line 134 to the retracting section 130. Thus, the retracting section 130 remains in its standby position.

When in the active position, the extending section 132 is operative to establish fluid communication between the high pressure fluid line 140 and the head side supply line 150 so that high pressure hydraulic fluid is delivered to the head side cavity 160. At the same time, the extending section 132 is operative to establish fluid communication between the high pressure fluid line 140 and the pilot line 220 so that high pressure hydraulic fluid is delivered to the sequence valve 200 to increase its bias. More specifically, because high pressure fluid is delivered concurrently to the pilot line 220 and to the head supply line 150 when the extending section 132 is in its active position, the bias added by the spring(s) 210 is operative to retain the sequence valve 200 in the first sequence and inhibit fluid communication between the head supply line 150 and the tank line 180. Likewise, the active position of the extending section 132 is operative to establish fluid communication between the rod side cavity 162 and the high pressure fluid line 140 via the rod side supply line 152 through the control valve 110 in a regenerative state.

Referring back to FIG. 2, when the retracting and extending sections 130, 132 are both in a standby position, the control valve 110 traps hydraulic fluid within the head supply line 150 and the rod supply line 152. At the same time, the control valve 110 establishes fluid communication between the pilot line 220 and the tank line 180, thereby bleeding off hydraulic fluid and pressure from the pilot line. By way of example, the tank line 180 is maintained with hydraulic fluid at a pressure of approximately 4 bar, which is substantially less than the pressure of hydraulic fluid carried within the high pressure line 140. In a circumstance where the retracting and extending sections 130, 132 are both in a standby position, the sequence valve 200 is biased to inhibit repositioning from the first sequence to the second sequence via the spring (s) 210 and establishing fluid communication between the lower pressure tank line 180 and the higher pressure head supply line 150. As discussed previously, the bias exerted by the spring(s) 210 alone is operative inhibit the sequence valve 200 from moving to the second sequence until the pressure within the head supply line 150 reaches a predetermined high pressure (e.g., 220 bar). Upon reaching the predetermined high pressure or greater within the head supply line 150, without any appreciable bias from the pressure within the pilot line 220, the sequence valve 200 moves to the second sequence to establish fluid communication between the first inlet 202 and the second outlet 208, thus bleeding off hydraulic fluid and pressure from the head supply line through the tank line 180. Pressures of 220 bar or greater may be achieved when rebound forces are applied to the head side when neither of the sections 130, 132 is in an active position.

Referring back to FIG. 3, when the retracting section 130 is in its active position, rebound forces applied to the rod side are accounted for by having the head supply line 150 in fluid communication with the tank line 180, thereby bleeding off any pressure spikes. In contrast, rebound forces applied to the head side are counteracted primarily by the high pressure on the rod side via the high pressure hydraulic fluid supplied to the rod side cavity 162 based upon the active position of the retracting section 130.

Referring back to FIG. 4, when the extending section 132 is in its active position, rebound forces applied to the rod side are accounted for by repositioning the sequence valve 200 from the first sequence to the second sequence, thereby establishing fluid communication between the head supply line 150 and the tank line 180 to bleed off any pressure spikes. In contrast, rebound forces applied to the head side are counteracted primarily by the high pressure on the rod side via the high pressure hydraulic fluid supplied to the rod side cavity 162 based upon the active position of the extending section 132.

The foregoing exemplary hydraulic sub-system 100 has not been described to utilize a sequence valve in communication with the rod supply line 152 because rebound forces applied to the rod side of the cylinder cause the rod to be in tension. The rod is more readily capable of enduring tension forces, as opposed to compressive forces that may buckle the rod. However, it is also within the scope of the invention for the rod supply line to be in communication with its own sequence valve.

It should be noted that the exemplary pressures, both default and operating, of the respective lines 150, 152, 180, 220 are exemplary in nature and may be changed to accommodate various operating pressures. Likewise, the opening pressures of the relief valves 170, 172 and the anti-cavitation valves 190, 192 may be set above or below those discussed above. Likewise, the bias of the sequence valve 200 may be changed to reposition the valve to the second sequence at pressures above or below those discussed above.

Following from the above description and invention summaries, it should be apparent to those of ordinary skill in the art that, while the methods and apparatuses herein described constitute exemplary embodiments of the present invention, the invention is not limited to the foregoing and changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

The invention claimed is:

1. A pressurized fluid subassembly comprising:

a fluid driven actuator configured to utilize a fluid at a high pressure to change an overall length of the fluid driven actuator; and a sequence valve interposing a low pressure line and a supply line conveying the fluid to the fluid driven actuator, the sequence valve including a first sequence configured to inhibit fluid communication between the supply line and the low pressure line when the fluid at the high pressure is actively supplied to the fluid driven actuator, the sequence valve including a second sequence configured to establish fluid communication between the supply line and the low pressure line when the fluid at the high pressure is not actively supplied to the fluid driven actuator, wherein the sequence valve includes a variable bias that changes depending upon whether the fluid at the high pressure is actively supplied to the fluid driven actuator; wherein the fluid driven actuator comprises a piston and a cylinder, the cylinder and the piston cooperating to define a head side cavity and a rod side cavity that are interposed by a head of the piston;

the supply line comprises a head side supply line conveying the fluid to the head side cavity;

the supply line comprises a rod side supply line conveying the fluid to the rod side cavity; and, the sequence valve is in fluid communication with the head side supply line conveying the fluid to the head side cavity, the sequence valve is configured to inhibit fluid communication between the head side supply line and the low pressure line when the fluid at the high pressure is actively supplied to the fluid driven actuator, the sequence valve is configured to establish fluid communication between the head side supply line and the low pressure line when the fluid at the high pressure is not actively supplied to the fluid driven actuator.

2. The pressurized fluid subassembly of claim 1, further comprising a control valve having a repositionable flow control configured to establish fluid communication between a high pressure source and the sequence valve via a pilot line and configured to establish fluid communication between the high pressure source and at least one of the head side cavity and the rod side cavity when the repositionable flow control is in its active position, the repositionable flow control configured to discontinue fluid communication between the high pressure source and the sequence valve via the pilot line and configured to discontinue fluid communication between the high pressure source and both the rod side cavity and the head side cavity when the repositionable flow control is in its standby position, wherein a pressure within the pilot line comprises the variable bias.

3. The pressurized fluid subassembly of claim 2, wherein:

the control valve comprises a spool valve;

the repositionable flow control comprises a first spool section; and, the first spool section is repositionable between the active position and the standby position, where the active position establishes fluid communication between the high pressure source and the sequence valve via the pilot line and establishes fluid communication between the high pressure source and the head side cavity, and where the standby position discontinues fluid communication between the high pressure source and the sequence valve via the pilot line and discontinues fluid communication between the high pressure source and the head side cavity.

4. The pressurized fluid subassembly of claim 2, wherein:

the control valve comprises a spool valve;

the repositionable flow control comprises a first spool section; and, the first spool section is repositionable between the active position and the standby position, where the active position establishes fluid communication between the high pressure source and the sequence valve via the pilot line and establishes fluid communication between the high pressure source and the rod side cavity, and where the standby position discontinues fluid communication between the high pressure source and the sequence valve via the pilot line and discontinues fluid communication between the high pressure source and the rod side cavity.

5. The pressurized fluid subassembly of claim 1, wherein:

the sequence valve includes:

a low pressure outlet in fluid communication with the low pressure line, a pilot inlet in fluid communication with a pilot line, a first high pressure inlet in fluid communication with the supply line, a second high pressure inlet in fluid communication with the supply line; and, a pressure within the second high pressure inlet detracts from the variable bias.

6. The pressurized fluid subassembly of claim 1, further comprising:

a relief valve in fluid communication with the supply line; and, an anti-cavitation valve in fluid communication with the supply line;

wherein:

the relief valve is configured to establish fluid communication between the supply line and the low pressure line when a pressure of the fluid within the supply line exceeds a high end pressure; and, the anti-cavitation valve is configured to establish fluid communication between the supply line and the low pressure line when the pressure of the fluid within the supply line falls below a low end pressure.

7. The pressurized fluid subassembly of claim 6, wherein:

the variable bias of the sequence valve is operative to inhibit fluid communication between the supply line and the low pressure line above the high end pressure when the fluid at the high pressure is actively supplied to the fluid driven actuator; and, the variable bias of the sequence valve is operative to establish fluid communication between the supply line and the low pressure line below the high end pressure when the fluid at the high pressure is not actively supplied to the fluid driven actuator.

8. The pressurized fluid subassembly of claim 1, further comprising a control valve having a repositionable flow control configured to establish fluid communication between a high pressure source and the sequence valve via a pilot line and configured to establish fluid communication between the high pressure source and the fluid driven actuator when the repositionable flow control is in its active position, the repositionable flow control configured to discontinue fluid communication between the high pressure source and the sequence valve via the pilot line and configured to discontinue fluid communication between the high pressure source and the fluid driven actuator when the repositionable flow control is in its standby position, wherein a pressure within the pilot line comprises the variable bias.

9. The pressurized fluid subassembly of claim 8, further comprising a controller in communication with the control valve, the controller configured to control repositioning of the flow control between the active position and the standby position.

10. The pressurized fluid subassembly of claim 9, wherein:

the control valve comprises a spool valve;

the repositionable flow control comprises a first spool section and a second spool section;

the first spool section is repositionable between the active position and the standby position, where the active position of the first spool section establishes fluid communication between the high pressure source and the sequence valve and establishes fluid communication between the high pressure source and a first cavity of the fluid driven actuator, and where the standby position of the first spool section discontinues fluid communication between the high pressure source and the sequence valve via and discontinues fluid communication between the high pressure source and the first cavity;

the second spool section is repositionable between the active position and the standby position, where the active position of the second spool section establishes fluid communication between the high pressure source and the sequence valve and establishes fluid communication between the high pressure source and a second cavity of the fluid driven actuator, and where the standby position of the second spool section discontinues fluid communication between the high pressure source and the sequence valve and discontinues fluid communication between the high pressure source and the second cavity;

the controller is in fluid communication with the first spool section via a first spool control line, the controller is configured to control repositioning of the first spool section by hydraulically repositioning the first spool section between the active position and the standby position; and, the controller is in fluid communication with the second spool section via a second spool control line, the controller is configured to control repositioning of the second spool section by hydraulically repositioning the second spool section between the active position and the standby position.

11. A pressurized fluid subassembly comprising:

a hydraulic cylinder having a first fluid port and a second fluid port, the first fluid port in communication with a head side cavity, the second fluid port in communication with a rod side cavity, the head side cavity and the rod side cavity interposed by a piston wall;

a sequence valve having a repositionable flow control and configured to have a first sequence that inhibits fluid communication between a first orifice of the sequence valve and a second orifice of the sequence valve, and the repositionable flow control configured to have a second sequence that establishes fluid flow through the sequence valve along a first pathway between the first orifice and the second orifice, the sequence valve also including a first bias opening and a second bias opening, the first and second bias openings in communication with the repositionable flow control and are configured to deliver a fluid to the repositionable flow control to cause repositioning of the repositionable flow control between the first sequence and the second sequence; and, a fluid line establishing fluid communication between the head side cavity of the hydraulic cylinder and the first orifice of the sequence valve, wherein the sequence valve is in fluid communication with the first fluid port, the sequence valve is configured to inhibit fluid communication between the first fluid port and a low pressure line when the fluid communication is at a high pressure and is actively supplied to the hydraulic cylinder, the sequence valve is configured to establish fluid communication between the first fluid port and the low pressure line when the fluid communication at the high pressure is not actively supplied to the hydraulic cylinder.

12. A pressurized fluid subassembly of claim 11, farther comprising a control valve in fluid communication with the head side cavity by way of a head side line, the control valve also in fluid communication with the rod side cavity by way of a rod side line, the control valve further in fluid communication with a hydraulic pump by way of a high pressure line, the control valve in still further fluid communication with a hydraulic reservoir by way of the low pressure line, and the control valve in yet further fluid communication with the first bias opening of the sequence valve by way of a pilot line.

13. A pressurized fluid subassembly of claim 11, further comprising:

a relief valve in fluid communication with the fluid line, the relief valve configured to have a constant bias to allow venting of contents of the fluid line if the pressure of the contents exceeds a maximum operating pressure; and, an anti-cavitation valve in fluid communication with the fluid line, the anti-cavitation valve configured to have a constant bias to allow additional contents to flow into the fluid line if the pressure of the contents within the fluid line falls below a minimum operating pressure;

wherein the repositionable flow control of the sequence valve is configured to include a variable bias impacting whether the repositionable flow control is in the first sequence or the second sequence.

14. A pressurized fluid subassembly of claim 13, wherein:

the fluid line is in fluid communication with the second bias opening of the sequence valve;

the second orifice of the sequence valve is in fluid communication with the low pressure line;

the control valve is configured to concurrently establish fluid communication between the high pressure line and the head side cavity and establish fluid communication between the high pressure line and the first bias opening;

the repositionable flow control of the sequence valve is configured to include a variable bias impacting whether the repositionable flow control is in the first sequence or the second sequence; and, the variable bias includes a constant spring bias to bias the repositionable flow in the first sequence.

15. A pressurized fluid subassembly of claim 14, wherein:

the control valve comprises a spool valve having a first spool section and a second spool section;

the first spool section is configured to be repositionable between an active position and a standby position, where the active position of the first spool section establishes fluid communication between the high pressure line and (a) the rod side cavity, and (b) a first sequence opening, where the active position of the first spool section also establishes fluid communication between the head side cavity and the low pressure line;

the second spool section is configured to be repositionable between an active position and a standby position, where the active position of the second spool section establishes fluid communication between the high pressure line and (a) the rod side cavity, and (b) the first sequence opening; and, the control valve is configured to inhibit fluid communication between the high pressure line and (a) the rod side cavity, (b) the head side cavity, and configured to establish fluid communication between a pilot line and the low pressure line, when the first and second spool sections are both in the standby position.

16. A method of operating a pressurized fluid subassembly comprising:

actively supplying a fluid at a high pressure to a fluid driven actuator and to a sequence valve, where the fluid at the high pressure supplied to the fluid driven actuator is operative to actively reposition the fluid driven actuator, the fluid at the high pressure supplied to the sequence valve increases a bias of the sequence valve to inhibit fluid communication between the fluid at the high pressure and a lower pressure drain; and, discontinuing actively supplying the fluid at the high pressure to the fluid driven actuator and to the sequence valve, where discontinuing actively supplying the fluid at the high pressure to the fluid driven actuator discontinues active repositioning of the fluid driven actuator, and where discontinuing actively supplying the fluid at the high pressure to the sequence valve reduces the bias of the sequence valve to allow fluid communication between the lower pressure drain and the fluid driven actuator when a pressure of the fluid within the fluid driven actuator exceeds a maximum working pressure.

17. The method of claim 16, further comprising venting, while discontinuing actively supplying the fluid at the high pressure to the fluid driven actuator and to the sequence valve, the fluid in communication with the fluid driven actuator via the sequence valve to the lower pressure drain during the fluid exceeding the maximum working pressure.

18. The method of claim 16, further comprising venting, while actively supplying a fluid at a high pressure to a fluid driven actuator and to a sequence valve, the fluid in communication with the fluid driven actuator via a check valve to the lower pressure drain during the fluid exceeding the high pressure by a predetermined threshold.

19. The method of claim 16, further comprising operating a control valve in fluid communication with the fluid driven actuator and the sequence valve, wherein operating the control valve includes establishing fluid communication between a high pressure fluid source and both the fluid driven actuator and the sequence valve when in a first position, and wherein operating the control valve includes discontinuing fluid communication between the high pressure fluid source and both the fluid driven actuator and the sequence valve when in a second position.

* * * * *